United States Patent [19]

Ahrendt et al.

[11] 4,383,655

[45] May 17, 1983

[54] YARN STORAGE DEVICE

[75] Inventors: Gerhard Ahrendt, Hohentengen; Roland Benz, Denkendorf; Reinhold Engenhart, Blochingen; Viktor Schmidt, Saulgau, all of Fed. Rep. of Germany

[73] Assignee: Lucke Apparate-Bau GmbH, Mengen, Fed. Rep. of Germany

[21] Appl. No.: 251,725

[22] Filed: Apr. 7, 1981

[30] Foreign Application Priority Data

Apr. 16, 1980 [DE] Fed. Rep. of Germany ..... 3014596

[51] Int. Cl.[3] ..... B65H 51/20; B65H 51/22

[52] U.S. Cl. ..... 242/47; 242/47.08; 242/47.12

[58] Field of Search ..... 242/47.08, 47, 47.01, 242/47.12, 47.13, 47.1, 47.11

[56] References Cited

FOREIGN PATENT DOCUMENTS

| | | | |
|---|---|---|---|
| 1936664 | 2/1971 | Fed. Rep. of Germany | 242/47.01 |
| 2847291 | 5/1980 | Fed. Rep. of Germany | 242/47 |
| 2024271 | 1/1980 | United Kingdom | 242/47.11 |

*Primary Examiner*—Stanley N. Gilreath

*Attorney, Agent, or Firm*—Shenier & O'Connor

[57] ABSTRACT

A yarn storage device has a plurality of vertically extending screw spindles spaced around a circle. The lower ends of the spindles are received in a bearing plate and are coupled to drive means for rotating each spindle about its own axis. A lap flyer is rotatable around said spindles by said drive means for applying loops of yarn around said spindles. An upwardly conically tapering drum is arranged concentrically to and within said circle such that the loops of yarn are transferred from the free upper ends of said spindles onto said drum and are pushed upwardly along the surface of the drum by subsequent loops. Yarn drawn off from the upper end of the drum has a substantially constant tension.

4 Claims, 5 Drawing Figures

YARN STORAGE DEVICE

BACKGROUND OF THE INVENTION

The present invention relates to a yarn storage device, for the continuous intermediate storage in loose form of a yarn to be drawn off.

Such yarn storage devices are used for supplying yarn under a uniform tension to a yarn-processing machine, for example to a ball-winding machine. They are interposed between a feed machine, for example a steaming machine, and the yarn-processing machine in order to equalise the uneven run-off tension prevailing on the feed machine. The capacity of such a store can be, for example, 1 kg or 2,000 m of yarn. The stored yarn represents, at the same time, a reserve for when the feed machine temporarily no longer supplies any yarn.

In a known yarn storage device (German published Patent Application 28 47 291), a rotating lap flyer is arranged to loop yarn around a plurality of screw spindles and the yarn is then transferred to an intermediate store. The intermediate store is formed by substantially horizontally arranged rods which extend slightly conically to one another and on which the yarn is suspended in the form of loops. The yarn loops are then pushed forwards towards the free end of the rods, where the yarn can then be drawn off and supplied to a yarn-processing machine. It has been shown that, with this device, an uneven run-off tension occasionally arises which may be attributable to the fact that only parts of the yarn loops are guided by the rods. Near the drawing-off point, the yarn tends to "beat" between the rods and this also impairs the uniformity of the run-off tension.

It is an object of the present invention to provide a yarn storage device from which the yarn can be drawn off at a substantially constant tension at the free end of the intermediate store.

SUMMARY OF THE INVENTION

According to the present invention there is provided a yarn storage device comprising a plurality of screw spindles extending substantially vertically, drive means for rotating each screw spindle about its own axis, said screw spindles being spaced around a circle, a lap flyer rotatable about said screw spindles for applying loops of yarn around said spindles, and an upwardly conically tapering drum with a smooth outer wall arranged concentrically to and within said circle such that said loops of yarn around said spindles are successively transferred from the upper ends of said spindles onto said drum and are pushed upwardly by subsequently transferred loops of yarn.

BRIEF DESCRIPTION OF THE DRAWINGS

An embodiment of the present invention will hereinafter be described, by way of example, with reference to the accompanying drawings, in which:-

DESCRIPTION OF A PREFERRED EMBODIMENT

Figure 1:
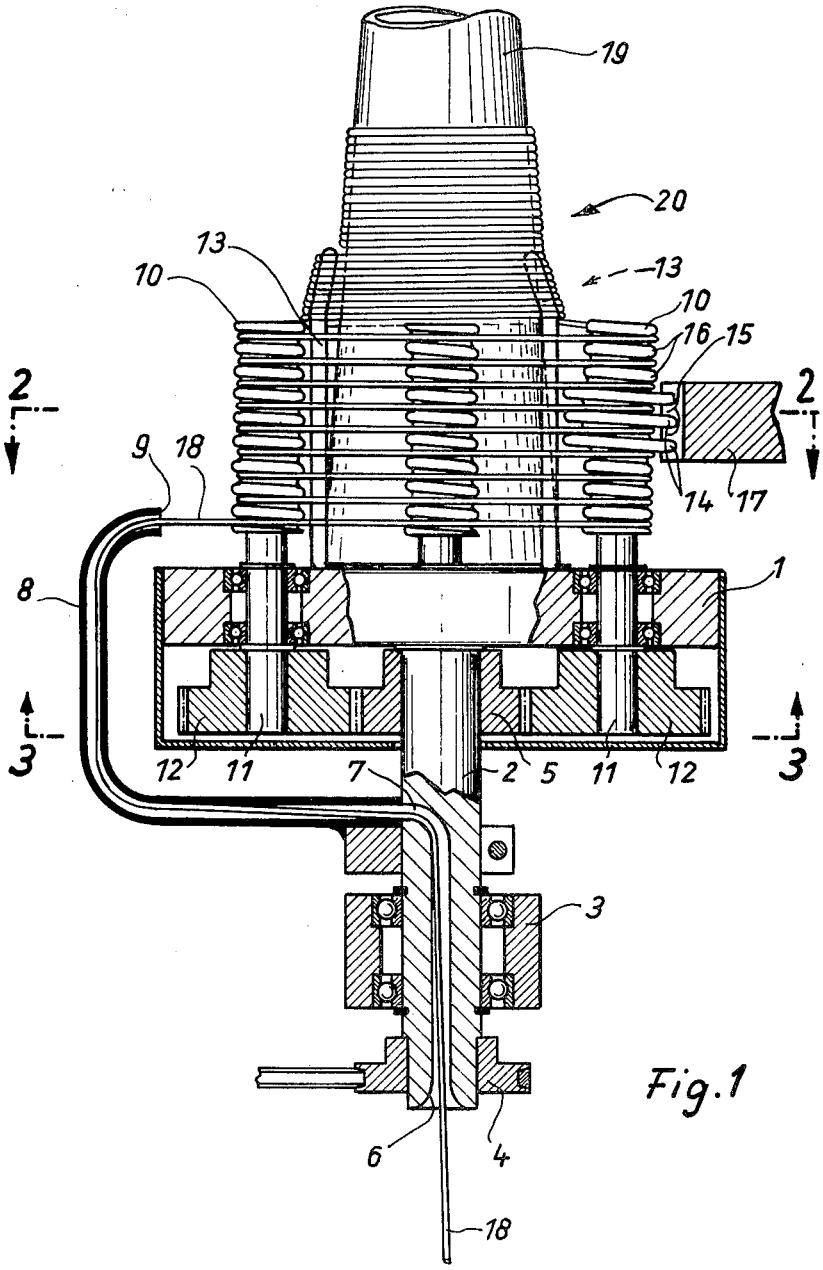
FIG. 1 shows a side view, partly in section, of a yarn storage device.
Figure 4:
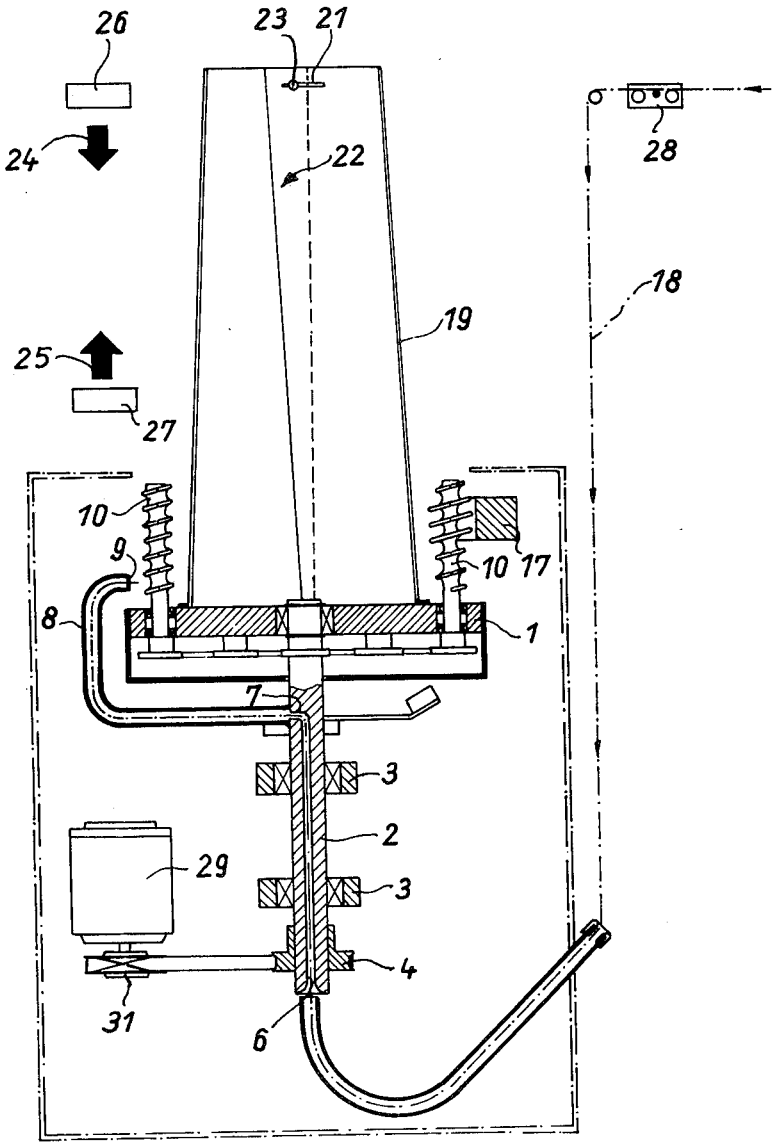
FIG. 4 shows diagrammatically the yarn storage device of FIG. 1 together with a drive unit shortly before the yarn is attached to an intermediate store.

As illustrated in FIGS. 1 and 4, the free end of a bearing shaft 2 is rotatably supported in a bearing plate 1. The bearing shaft 2 is also rotatably mounted in a fixed bearing 3. The bearing shaft 2 can be rotated by a motor 29 via a belt pulley 4 connected to the bearing shaft. A spur wheel 5 is rotationally fixed on the bearing shaft 2 in the vicinity of the bearing plate 1. The bearing shaft 2 has a concentric blind hole 6 which merges at its end into a radial bore 7 connected to which is a tubular lap flyer 8 which projects radially from the bearing shaft 2 and which is rigidly joined thereto. This lap flyer is curved in such a way that its free end 9 terminates above the bearing plate 1.

Figure 2:
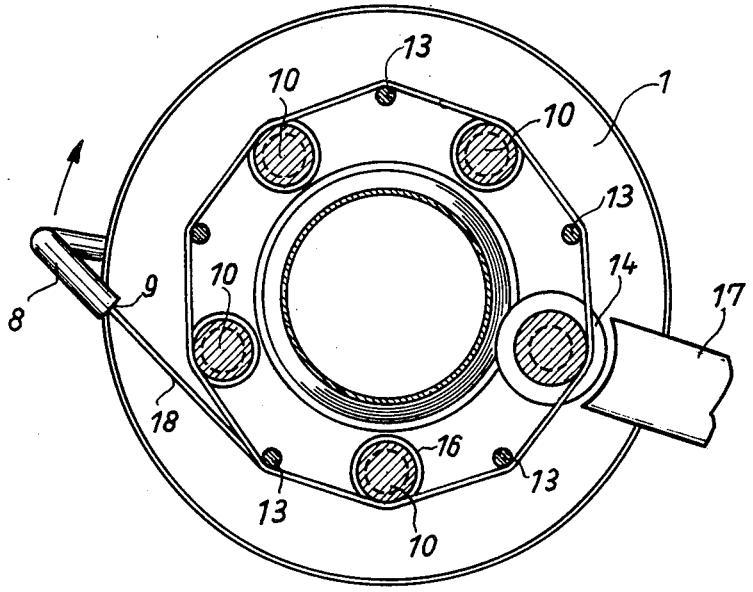
FIGS. 2 and 3 show cross-sections of the yarn storage device taken along line 2—2 and 3—3 of FIG. 1, respectively.
Figure 3:
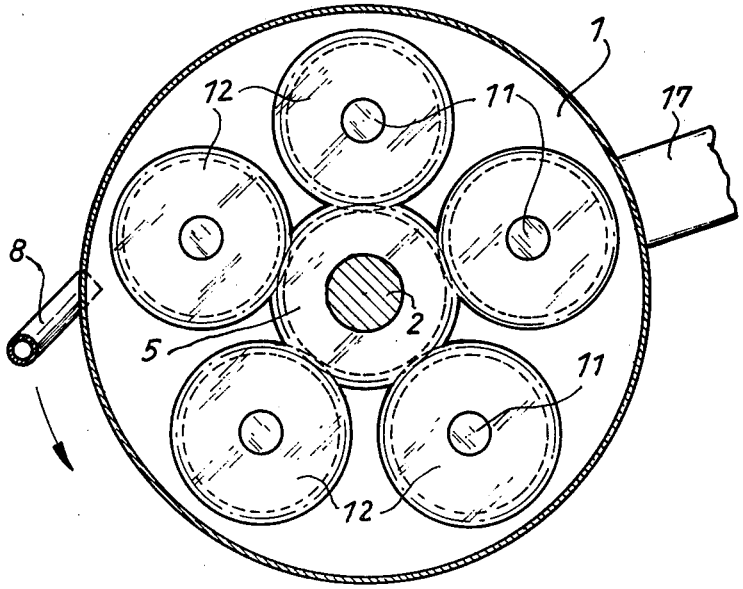

Five screw spindles 10 are rotatably mounted in the horizontally arranged bearing plate 1 to the vertical bearing shaft 2, and the axes of rotation of the spindles 10 each extend vertically and parallel to the vertical bearing shaft 2. The five spindles 10 are equally angularly spaced on the periphery of a circle which is concentric with the bearing shaft 2 (FIG. 2). The screw spindles 10 are arranged on the side of the bearing plate 1 opposite to the bearing shaft 2. Extensions 11 of the screw spindles 10 extend through the bearing plate 1 and are each rotationally fixed to a respective gear wheel 12 which meshes with the spur wheel 5. The spur wheel 5 and the gear wheels 12 have the same number of teeth.

Let into the bearing plate 1, between the spindles 10, are guide pins 13 which, like the screw spindles 10, extend vertically upwardly and are held at one end only.

The screw spindles 10 have screw threads 15 defined between shoulders 16. One of the screw spindles 10 (on the right in FIG. 1) has shoulders 14 between adjacent screw threads 15 which have a larger radius than the shoulders 16 in the remaining region of the spindle. A holder 17 having, at its end facing the one screw spindle 10, a form corresponding to the periphery of the spindle engages on these enlarged shoulders 14. The holder 17 is fixed, for example, is connected to a machine frame (not shown). This holder 17 prevents rotation of the bearing plate 1 about the axis of the bearing shaft 2.

It will be appreciated that when the bearing shaft 2 rotates the bearing plate 1 and hence the screw spindles 10 are prevented from rotating about the bearing shaft 2. The spur wheel 5 rotates with the bearing shaft 2 and rotates each of the gear wheels 12 and hence each of the screw spindles 10 is rotated about its own axis at a speed equal to the rotational speed of the shaft 2.

A thread, yarn or the like 18 is supplied through the blind hole 6, the bore 7 and the lap flyer 8 and, as the lap flyer 8 rotates, is inserted into appropriate screw threads 15 of the spindles 10. Because, in the embodiment illustrated, the lap flyer 8 rotates in the opposite direction to the screw spindles 10, the yarn 18 is laid round all the spindles 10, the thread following an approximately circular path which is determined not only by the screw spindles 10, but also by the guide pins 13 (FIG. 2).

When the lap flyer 8 arrives, during its rotary movement, at a spindle 10 into which it inserted the yarn in the course of the previous revolution, this spindle has also executed a complete revolution as a result of the synchronisation of movement which is present. The thread has thereby been transported one thread pitch towards the free upper end of the spindle, so that, the lap flyer 8 is positioned to supply yarn to the next free screw thread. This operation is repeated on all the screw spindles. In this way, the yarn extends, in substantially concentric circles, over the entire height of the screw spindles 10, the spacing between adjacent layers of yarn corresponding to the thread pitch of the screw spindles.

The circular yarn loops are finally released by the revolving spindles at their free ends located at the top in FIG. 1, the release being effected in succession on the individual spindles.

As is evident from the drawings, an upwardly conically tapering drum 19 which acts as an intermediate store is rigidly fixed at its lower end to the bearing plate 1. The drum 19 is arranged concentrically with respect to and within the circle on which the screw spindles 10 are arranged. The yarn loops 20 which are detached from the free ends of the spindles 10 gradually run onto this drum, and they are guided, if appropriate, by suitably angled ends of the guide pins 13 as shown in FIG. 1. The yarn is applied to the spindles 10 by the lap flyer 8 under tension. Because of the intrinsic elasticity of the yarn, the yarn loops 20 which are transferred from the spindles 10 to the conical drum 19 assume a smaller diameter which corresponds approximately to the diameter of the drum as shown in FIG. 1.

The shell of the drum 19 consists preferably of a stainless steel sheet with a polished surface. On the smooth outer wall of the drum, the yarn loops applied first to the drum at any given time are constantly pushed slowly upwardly by following loops, until, finally, the entire drum shell (see FIG. 5) is covered with yarn loops 20. The yarn 18 can now be drawn off from the upper end of the drum 19 with a constantly uniform tension and supplied, for example, to a ball-winding machine.

It has been found, surprisingly, that the advance imparted to the yarn loops 20 solely by the spindles 10 is sufficient to press the yarn loops constantly upwardly along the drum shell. It can happen that a slight crowding of the yarn occurs at the point of transition from the screw spindles 10 to the drum 19, at which point the yarn loops 20 may be compressed in the form of a bead. However, all the loops are gradually pushed upwardly towards the free end of the drum 19. In this operation, the elasticity of the yarn assists the laying of the loops on the drum.

The drum 19 is formed from a sheet whose side edge regions are overlapped as indicated at 22 in FIG. 4 to give the conical shape to the drum. Towards the upper edge of the sheet, one of the overlapping side edge regions is provided with a horizontally extending slit 21 whilst the other side edge region is provided with a hole congruent with the slit 21. Guided through the slit 21 and the hole is a screw 23 whose head is countersunk in the outer layer, so that it does not impede the yarn loops 20 which are pushed upwardly. If the screw 23 is slackened, the conical form of the drum 19 can be varied and adapted to the sliding capacity, elasticity and, possibly, also the strength of the yarn by pushing the two side regions in the region 22 of the sheet over one another to a greater or lesser extent. After the desired conical form has been established, the screw 23 is tightened again.

In order to keep the spacing between the drum shell and screw spindles 10 as small as possible at the end of the drum 19 connected to the bearing plate 1, it is also possible to provide in the lower end of the drum shell appropriate recesses into which the screw spindles 10 (and, if appropriate, the guide pins 13) partly penetrate.

Figure 5:
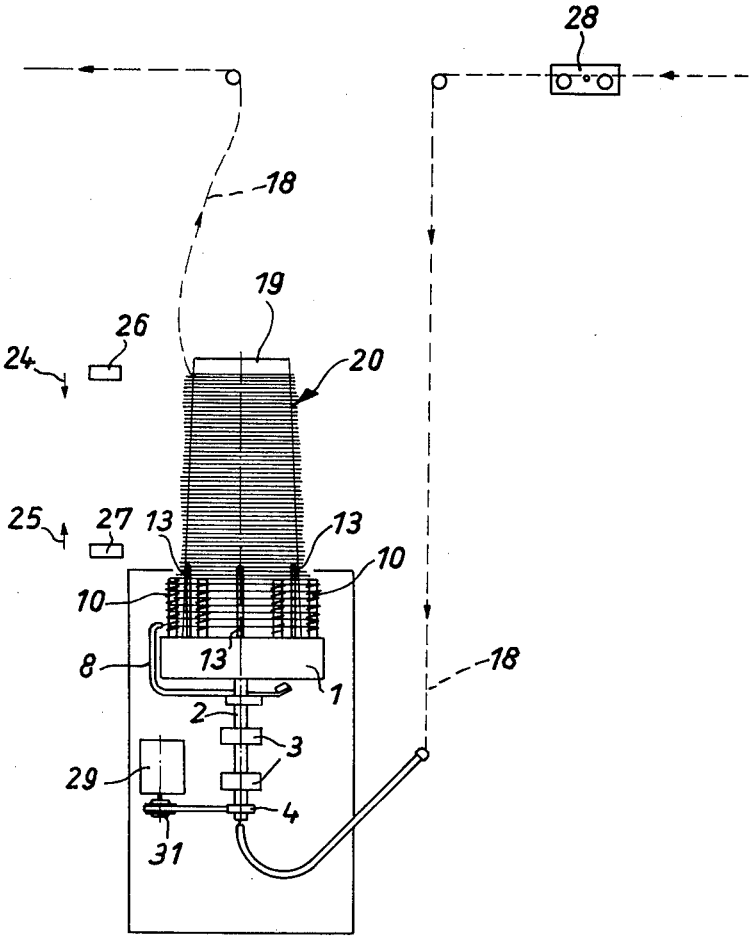
FIG. 5 shows diagrammatically the operation of the yarn storage device of FIG. 4.

As illustrated diagrammatically in FIGS. 4 and 5, two photocells 26 and 27 are provided adjacent the drum 4. These photocells 26 and 27 are vertically adjustable as indicated by the arrows 24, 25 and are arranged to scan the yarn loops 20 on the drum 19 and to respond to the presence of yarn loops 20 at their respective vertical position. When the photocell 26 responds, this indicates that the drum 19 is fully loaded with yarn loops 20. In this case, the drawing-off speed must be increased or the supply of yarn by the lap flyer 8 interrupted. When the photocell 27 responds, the quantity of yarn stored intermediately on the drum 19 is practically used up and the rate of supply of the yarn 18 must be increased. The photocells 26, 27 can be used directly for machine control or can simply transmit an alarm signal so that an operator can take the necessary measures.

It has been shown, in practice, that the yarn 18 stored intermediately on the drum 19 can be drawn off from the upper end of the drum 19 practically without tension and can constantly be supplied uniformly to a yarn-processing machine. A thread monitor 28, known per se, which is interposed in the yarn path leading to the yarn storage device is arranged to switch off the motor 29 in the case of thread breakage. The rate of application of the yarn to the drum 19 can be made infinitely adjustable by means of a regulating pulley 31 attached to the motor 29.

It is also possible to provide more than five screw spindles 10 on the storage device if required.

We claim:

1. A storage device for yarns having intrinsic elasticity comprising a stationary bearing plate, a plurality of screw spindles extending substantially vertically and being held at their lower ends on the bearing plate, drive means for rotating each screw spindle about its own axis, said screw spindles being spaced around a circle, a lap flyer rotatable about said spindles for applying loops of yarn around said spindles, guide means extending vertically between the screw spindles and being held at their lower ends on the bearing plate, and an upwardly conically tapering drum with a smooth outer wall arranged concentrically to and within said circle, the upper free ends of the guide means being angled and directed to said drum, the arrangement being such that said loops of yarn around said spindles are successively transferred from the upper ends of said spindles onto said angled ends of the guide means and onto said drum and are pushed upwardly by subsequently transferred loops of yarn.

2. A yarn storage device according to claim 1, wherein the conical form of the drum is adjustable.

3. A yarn storage device according to claim 1, wherein the drum is formed of a shell of sheet steel with a polished surface.

4. A yarn storage device according to claim 1, further comprising photocells arranged adjacent the drum for scanning the quality of yarn on the drum.

* * * * *